US010329685B2

(12) United States Patent
Gurt Santanach et al.

(10) Patent No.: US 10,329,685 B2
(45) Date of Patent: Jun. 25, 2019

(54) DEVICE INTENDED FOR IMPLEMENTING AN ANODIZATION TREATMENT AND ANODIZATION TREATMENT

(71) Applicants: SAFRAN HELICOPTER ENGINES, Bordes (FR); SAFRAN LANDING SYSTEMS, Velizy Villacoublay (FR)

(72) Inventors: Julien Gurt Santanach, Saint Vincent de Tyrosse (FR); Alain Viola, Ernolsheim (FR)

(73) Assignees: SAFRAN HELICOPTER ENGINES, Bordes (FR); SAFRAN LANDING SYSTEMS, Velizy-Villacoublay (FR)

( * ) Notice: Subject to any disclaimer, the term of this patent is extended or adjusted under 35 U.S.C. 154(b) by 120 days.

(21) Appl. No.: 15/307,237

(22) PCT Filed: Apr. 20, 2015

(86) PCT No.: PCT/FR2015/051062
§ 371 (c)(1),
(2) Date: Oct. 27, 2016

(87) PCT Pub. No.: WO2015/166165
PCT Pub. Date: Nov. 5, 2015

(65) Prior Publication Data

US 2017/0051427 A1 Feb. 23, 2017

(30) Foreign Application Priority Data

Apr. 30, 2014 (FR) ..... 14 53990

(51) Int. Cl.
*C25B 15/08* (2006.01)
*C25B 9/00* (2006.01)
(Continued)

(52) U.S. Cl.
CPC ..... *C25D 21/12* (2013.01); *C25D 11/005* (2013.01); *C25D 11/026* (2013.01); *C25D 17/02* (2013.01);
(Continued)

(58) Field of Classification Search
CPC ..... C25B 15/08; C25B 9/00; C25B 15/02; C25B 9/18; C25B 9/16; C25D 17/00; C25D 21/14
(Continued)

(56) References Cited

U.S. PATENT DOCUMENTS 5,338,416 A * 8/1994 Mlcak ..... C25F 3/12 205/643
9,790,611 B2 * 10/2017 Yoshida ..... C25D 11/005
(Continued)

FOREIGN PATENT DOCUMENTS

CN 1900381 A 1/2007
EP 0 410 919 A1 1/1991
(Continued)

OTHER PUBLICATIONS

International Search Report dated Jul. 24, 2015 in PCT/FR2015/051062 filed Apr. 20, 2015.

*Primary Examiner* — Zulmariam Mendez
(74) *Attorney, Agent, or Firm* — Oblon, McClelland, Maier & Neustadt, L.L.P.

(57) ABSTRACT

A device for performing anodizing treatment on a part, the device including a treatment chamber including a part for anodizing together with a counter-electrode situated facing the part to be treated, the part to be treated constituting a first wall of the treatment chamber; a generator, a first terminal of the generator being electrically connected to the part to be treated and a second terminal of the generator being electrically connected to the counter-electrode; and a system for
(Continued)

storing and circulating an electrolyte, the system including a storage vessel, different from the treatment chamber, for containing the electrolyte; and a circuit for circulating the electrolyte in order to enable the electrolyte to flow between the storage vessel and the treatment chamber.

12 Claims, 2 Drawing Sheets

(51) Int. Cl.

| | |
|---|---|
| ***C25B 15/02*** | (2006.01) |
| ***C25D 21/12*** | (2006.01) |
| ***C25D 11/02*** | (2006.01) |
| ***C25D 17/02*** | (2006.01) |
| ***C25D 17/12*** | (2006.01) |
| ***C25D 21/06*** | (2006.01) |
| ***C25D 21/18*** | (2006.01) |
| ***C25D 11/00*** | (2006.01) |

(52) U.S. Cl.
CPC ..... *C25D 17/12* (2013.01); *C25D 21/06* (2013.01); *C25D 21/18* (2013.01)

(58) Field of Classification Search
USPC ..... 204/237
See application file for complete search history.

(56) References Cited

U.S. PATENT DOCUMENTS

| | | | | |
|---|---|---|---|---|
| 2003/0094377 | A1 | 5/2003 | Krishna et al. | |
| 2004/0217012 | A1 | 11/2004 | Gramm | |
| 2005/0077183 | A1 | 4/2005 | Yagi et al. | |
| 2014/0151239 | A1 * | 6/2014 | Kobayashi | C25D 11/022 205/333 |

FOREIGN PATENT DOCUMENTS

| | | | | |
|---|---|---|---|---|
| JP | 59-166696 | A | 9/1984 | |
| JP | 2009-185331 | A | 8/2009 | |
| WO | 2005/052221 | A1 | 6/2005 | |
| WO | WO-2014002520 | A1 * | 1/2014 | C25D 11/022 |

* cited by examiner

DEVICE INTENDED FOR IMPLEMENTING AN ANODIZATION TREATMENT AND ANODIZATION TREATMENT

BACKGROUND OF THE INVENTION

The invention relates to devices for performing anodizing treatment, preferably micro arc anodizing treatment, and it also relates to associated methods.

It is known to treat alloys based on magnesium, aluminum, or titanium by micro arc anodizing. That technique serves to make layers with very low porosity and of hardness that is much greater than the hardness of an amorphous oxide that could be obtained by conventional anodizing such as sulfuric anodic oxidation (SAO), chromic anodic oxidation (CAO), or phosphoric anodic oxidation (PAO). Specifically, in micro arc anodizing treatments, the oxide layer on the surface of the part is formed as a result of generating microelectric discharges leading to the formation of micro arcs that have the ability to raise the temperature of the surface of the part very locally so as to crystallize the amorphous oxide that forms during the anodizing step. In micro arc anodizing treatment, the parts may be immersed in an aqueous electrolyte and they are exposed to oscillating pulses of electrical energy by a specific electronic generator, and if necessary by a counter-electrode of shape matching the parts. Microscopic light-emitting discharges are then visible at the surfaces of such parts, which discharges are due to dielectric breakdowns in the hydroxide layer, and they can be considered as being microplasmas.

The main parameters of the treatment (frequency of the electrical signal, current density, duration for which the parts are immersed in the bath, temperature, . . . ) can be modulated and controlled as a function of the material of the treated part, of its shape, and of the properties desired for the layer of anodizing.

Nevertheless, making a coating by the present micro arc anodizing technique in a large vessel (vessel having a volume of about 0.5 cubic meters ($m^3$)) can present several limits.

Firstly, that technique can involve using a generator delivering high value bipolar currents, given the large surface area of the part(s) for treatment, which can lead to high levels of electricity consumption. Furthermore, it can be difficult to obtain a coating by micro arc anodizing on a part of large area because of the high currents needed for anodizing.

Furthermore, since micro arc anodizing treatment consumes a large amount of energy, the temperature of the electrolyte in prior art bath treatments can be difficult to control. Nevertheless, it is necessary to control the temperature of the bath in order to ensure that the coating is properly made. The desire to regulate the temperature of the bath can lead to using an installation that is relatively complex, thereby significantly increasing the cost of performing the treatment.

Another disadvantage of prior art micro arc anodizing methods is that it can be difficult to measure reliably certain parameters of the electrolyte in the bath while the anodizing treatment is being performed. Reliable measurements of such parameters are nevertheless desirable, e.g. in order to be able to modify the anodizing treatment being performed as a function of the information determined from such measurements.

Finally, in order to perform micro arc anodizing on a part in a well-specified zone, it is possible to use resists that may be of organic type, e.g. a varnish, or of inorganic type, e.g. resulting from conventional anodizing, for the purpose of preventing the micro arc anodizing layer being formed over the entire surface of the part. Resists serve in particular to insulate the surface of the underlying part electrically from the electrolyte, thereby preventing that surface being anodized. Nevertheless, putting resists into place can be relatively expensive and can make the organization of fabrication significantly more complex. Furthermore, the masking step may be difficult to perform and can thus make the treatment significantly more expensive.

There thus exists a need to provide devices that enable anodizing treatment to be performed in simple and inexpensive manner, and in particular micro arc anodizing treatment.

There also exists a need to provide devices that enable the temperature of the electrolyte during anodizing treatment to be controlled effectively, and in particular during micro arc anodizing treatment.

There also exists a need to provide novel devices suitable for performing treatments in addition to anodizing and making it possible in particular to monitor reliably the parameters of the electrolyte in use during the anodizing treatment.

OBJECT AND SUMMARY OF THE INVENTION

To this end, in a first aspect, the invention provides a device for performing anodizing treatment on a part, the device comprising:

- a treatment chamber comprising a part to be treated and a counter-electrode situated facing the part to be treated, the part to be treated constituting a first wall of the treatment chamber;
- a generator, a first terminal of the generator being electrically connected to the part to be treated and a second terminal of the generator being electrically connected to the counter-electrode; and
- a system for storing and circulating an electrolyte, the system comprising:
  - a storage vessel, different from the treatment chamber, for containing the electrolyte; and
  - a circuit for circulating the electrolyte in order to enable the electrolyte to flow between the storage vessel and the treatment chamber.

The invention relies on the principle of using a treatment chamber that is "remote" from the electrolyte storage vessel, the part to be treated forming a wall of the treatment chamber. Unlike anodizing devices known in the prior art, the part to be treated is not immersed in the electrolyte, but only the surface of the part that is to be treated is in contact with the electrolyte during the anodizing treatment. Naturally, the surface of the part to be treated is electrically conductive, the part being constituted for example by a metal, e.g. aluminum, magnesium, and/or titanium.

The invention advantageously enables the anodizing treatment to be "concentrated" in a limited volume in the treatment chamber and makes it possible to use a treatment chamber of volume that is significantly smaller than that of a vessel used in prior art anodizing methods in which the part to be treated is immersed. Thus, in the invention, a treatment chamber is used that has a volume that matches the dimensions of the surface to be treated, and this presents several advantages.

Specifically, the invention makes it possible to achieve savings in terms of energy consumption compared with prior art methods since, while using the device of the invention, the power delivered by the generator is specifically proportional to the dimensions of the surface area to be treated. In addition, a part of large dimensions of the kind frequently encountered in the field of aviation, e.g. a part made of aluminum, can advantageously be anodized without having recourse to a vessel in which it can be totally immersed, as is required in known prior art methods, thus making it possible to achieve a saving in terms of the quantity of electrolyte that is used during the anodizing treatment.

It is thus possible to use a current and a quantity of electrolyte that match the dimensions of the surface area to be treated, as a result of using a treatment chamber of volume and of shape matching the surface to be treated. In addition, the use of such a treatment chamber advantageously makes expensive steps of installing resists or masks superfluous.

The invention thus provides devices enabling anodizing treatment to be performed in simple and inexpensive manner, and preferably micro arc oxidation treatment.

The device of the invention is preferably for use in performing micro arc oxidation treatment.

Devices of the invention also make it possible to have better control over the effects of heat being produced in the treated zone by enabling the electrolyte to be renewed effectively in the treatment chamber and by maintaining the treatment chamber under good mixture conditions. This renewal is made possible by the system for storing and circulating the electrolyte that enables the electrolyte to flow from the storage vessel to the treatment chamber and the electrolyte to return from the treatment chamber to the storage vessel. Such a system contributes to having better control over the anodizing treatment and leads to coatings that are easier to make so that they comply with the required specifications.

Advantageously, the system for storing and circulating the electrolyte may further include a pump for driving circulation of the electrolyte through said system.

In an embodiment, the device may be such that the circuit for circulating the electrolyte comprises:

- a first channel for enabling the electrolyte coming from the storage vessel to flow to the treatment chamber; and
- a second channel for enabling the electrolyte to flow from the treatment chamber to the storage vessel.

Advantageously, the treatment chamber may have a volume that is less than the volume of the storage vessel. The volume of the storage vessel and the volume of the treatment chamber correspond respectively to the inside volumes of said storage vessel and of said treatment chamber (i.e. not including the volumes of the walls). In particular, the ratio (volume of the treatment chamber)/(volume of the storage vessel) is less than or equal to 1, preferably less than or equal to 0.2.

In an embodiment, the device may include at least one sealing gasket constituting a second wall of the treatment chamber, the second wall being different from the first wall. In particular, the device advantageously includes two sealing gaskets situated facing each other and constituting two distinct walls of the treatment chamber.

In an embodiment, the treatment chamber may define a single compartment.

The present invention also provides a method of anodizing a part, the method comprising the following steps:

- forming a coating on a surface of the part by anodizing treatment using a device as defined above, an electrolyte being present in the treatment chamber during the anodizing treatment, and the electrolyte flowing in the electrolyte circulation circuit during the anodizing treatment.

The anodizing treatments of the invention present the advantages as described above.

Preferably, the anodizing treatment is micro arc oxidation treatment.

In an implementation, the electrolyte may flow in the electrolyte circulation circuit at a flow rate lying in the range 0.1 times to 10 times the volume of the treatment chamber, per minute.

Advantageously, the electrolyte present in the treatment chamber is continuously renewed during the anodizing treatment.

In an implementation, during the anodizing treatment:

- the electrolyte coming from the storage vessel may flow to the treatment chamber through the first channel; and
- the electrolyte may flow from the treatment chamber to the storage vessel through the second channel.

In an implementation, the method may also further include a step of filtering the electrolyte flowing in the second channel prior to its return into the storage vessel.

In an implementation, the method may also further include the following steps:

- determining at least information relating to the electrolyte flowing in the first channel and/or in the second channel; and
- modifying at least one characteristic of the anodizing treatment, this modification being performed as a function of the information determined about the electrolyte.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF EMBODIMENTS

Figure 1:
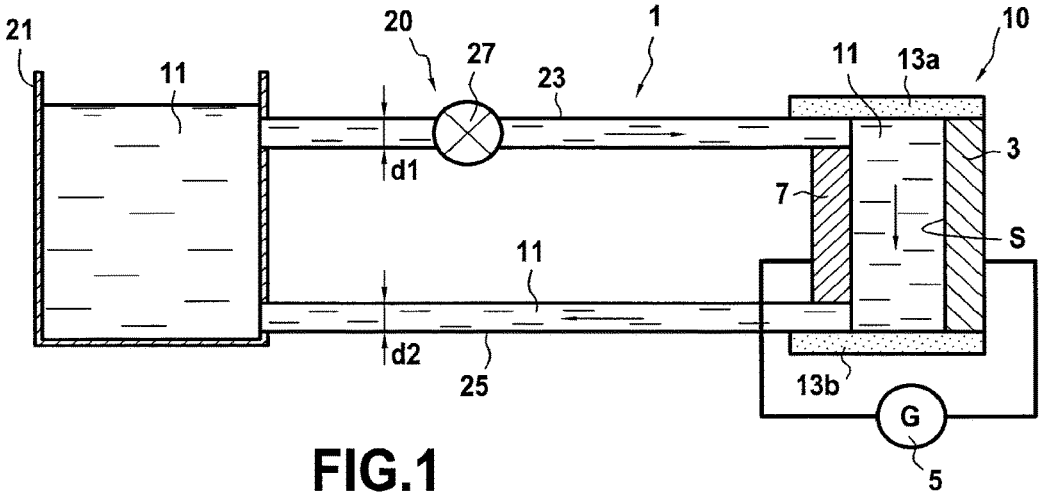
FIG. 1 shows an embodiment of a device of the invention.

FIG. 1 shows an embodiment of a device 1 of the invention. The device 1 comprises the part to be treated 3 and a generator 5. The part to be treated 3 is for being subjected to anodizing treatment, preferably micro arc oxidation. The generator 5 serves to perform this anodizing. As shown, a first terminal of the generator 5 is electrically connected to the part 3, and a second terminal of the generator 5 is electrically connected to a counter-electrode 7 situated facing the part 3. The generator 5 is advantageously configured to apply alternating current (AC).

The counter-electrode 7 is preferably made of stainless steel. More generally, it is possible to use any electrically-conductive material for the counter-electrode 7 providing it is compatible with performing anodizing treatment.

The device 1 has a treatment chamber 10 in which the anodizing treatment is to be performed, the part 3 to be treated constituting a first wall of the treatment chamber 10 and the counter-electrode 7 constituting a wall of the treatment chamber that is situated facing the first wall. An electrolyte 11 is present in the treatment chamber 10 between the part 3 and the counter-electrode 7. The electrolyte 11 has a chemical composition that enables the part 3 to be subjected to anodizing treatment. As shown, the counter-electrode 7 is not immersed in the electrolyte 11. The counter-electrode 7 forms a wall of the treatment chamber 10.

Thus, as shown, the part 3 to be treated is not immersed in the electrolyte 11 present in the treatment chamber 10. The part 3 constitutes a wall of the treatment chamber 10 so that only the surface S to be treated of the part 3 is in contact with the electrolyte 11. In the example shown, the part 3 is treated over its entire length, i.e. over its entire longest dimension. Naturally, it would not be beyond the ambit of the present invention for the part to be treated over a fraction only of its length. In the ambit of the invention, it is thus equally possible to perform anodizing treatment over a fraction only of a surface of a part or over an entire surface of a part.

In addition, the treatment chamber 10 comprises two sealing gaskets 13*a* and 13*b* situated facing each other and forming two distinct walls of the treatment chamber. As shown, the sealing gaskets 13*a* and 13*b* are present at the top and bottom ends of the treatment chamber 10. The gaskets 13*a* and 13*b* may be made of flexible material.

Thus, in the embodiment shown of the device 1 the electrolyte 11 used for anodizing is contained between the part 3 and the counter-electrode 7 by static sealing making use of the flexible gaskets 13*a* and 13*b*. The treatment chamber 10 thus constitutes a tank of electrolyte 11 for coating the surface S of the part 3. As mentioned above, the treatment chamber 10 has a volume and dimensions that are adapted to the dimensions and to the shape of the surface S to be treated of the part 3. In the example shown, the treatment chamber 10 defines a single compartment.

In addition, the device 1 includes a system 20 for storing and circulating the electrolyte 11. The system 20 comprises a storage vessel 21 in which the electrolyte 11 is stored, with the temperature of the electrolyte 11 stored in the storage vessel being maintained at a value that is determined by a cooling system (not shown). The pH of the electrolyte 11 present in the storage vessel 10 is also maintained at a fixed value. During anodizing treatment, the electrolyte 11 coming from the storage vessel 21 flows along a first channel 23 to the treatment chamber 10. The system 20 also has a second channel 25 enabling the electrolyte 11 to flow from the treatment chamber 10 to the storage vessel 21. The second channel 25 enables the electrolyte 11 present in the treatment chamber 10 to be discharged and returned to the storage vessel 21 where it can be cooled. The electrolyte 11 is caused to circulate through the system 20 by a pump 27. By way of example, the pump 27 may be a pump that is sold under the name YB1-25 by the supplier TKEN.

FIG. 1 includes arrows showing the flow direction of the electrolyte 11. The flow rate of the electrolyte 11 determined by the pump 27 enables the electrolyte 11 in the treatment chamber 10 to be renewed appropriately so as to enable the desired coating to be made by anodizing. It may be advantageous for the pump 27 to cause the electrolyte 11 to flow at a rate that is equal to about one volume of the treatment chamber 10 per minute. More generally, the pump 27 may advantageously cause the electrolyte 11 to flow at a rate lying in the range 0.1 times to 10 times the volume of the treatment chamber 10 per minute.

Advantageously, the flow of electrolyte 11 from the storage vessel 21 to the treatment chamber 10 and from the treatment chamber 10 to the storage vessel 21 is not interrupted throughout the duration of the anodizing treatment. In other words, it is preferred to renew the electrolyte 11 present in the treatment chamber 10 continuously throughout the anodizing treatment.

The first channel 23 may have a diameter $d_1$ over all or part of its length that is less than or equal to 10 centimeters (cm), e.g. lying in the range 1 cm to 3 cm. The second channel 25 may present a diameter $d_2$ over all or part of its length that is less than 10 cm, e.g. lying in the range 1 cm to 3 cm. The treatment chamber 10 may have a volume that is less than or equal to 0.5 $m^3$, e.g. lying in the range 10 cubic decimeters ($dm^3$) to 40 $dm^3$. The storage vessel 21 may have a volume greater than or equal to 0.5 $m^3$, e.g. lying in the range 0.5 $m^3$ to 2 $m^3$.

The materials forming the gaskets 13*a* and 13*b*, the first channel 23, and the second channel 25 are selected so as to ensure that electricity does not pass between the counter-electrode 7 and the part 3.

The device 1 shown in FIG. 1 serves to perform anodizing treatment on a part by part basis. As shown, the method performed by the device 1 shown in FIG. 1 advantageously does not include a step of masking a portion of the surface S of the part 3 or of putting into place at least one resist on the surface S of the part 3 to be treated.

The final thickness of the coating formed after anodizing treatment measured perpendicularly to the surface of the underlying part may lie in the range 2 micrometers (μm) to 200 μm.

There follows an example of operating conditions that may be implemented in order to perform micro arc oxidation treatment with a device 1 as described above:

- imposed current: 40 amps per square decimeter ($A/dm^2$) to 400 $A/dm^2$;
- voltage: 180 volts (V) to 600 V;
- pulse frequency: 10 hertz (Hz) to 500 Hz;
- duration of treatment: 10 minutes (min) to 90 min;
- temperature of the electrolyte in the storage vessel: 17° C. to 30° C.
- pH of the electrolyte in the storage vessel: 6 to 12; and
- conductivity of the electrolyte in the storage vessel: 200 millisiemens per meter (mS/m) to 500 mS/m.

In particular, for performing micro arc oxidation treatment, it is possible to use an electrolyte 11 having the following composition:

- demineralized water;
- potassium hydroxide (KOH) at a concentration lying in the range 5 grams per liter (g/L) to 50 g/L;
- sodium silicate ($Na_2SiO_3$) at a concentration lying in the range 5 g/L to 50 g/L; and
- potassium phosphate ($K_3PO_4$) at a concentration lying in the range 5 g/L to 50 g/L.

Nevertheless, the invention is not limited to performing a micro arc oxidation method. A device of the invention may be used for performing any type of anodizing, such as for example sulfuric anodic oxidation (SAO), chromic anodic oxidation (CAO), sulfotartric anodic oxidation (STAO), or sulfo-phosphoric anodic oxidation (SPAO).

By way of example, the treated part may be a blade, e.g. made of titanium, or a pump body. It is also possible to use a device of the invention to repair a layer of anodizing that has been damaged, the device making it possible to perform localized repair with a coating being formed by anodizing solely in the damaged zone.

In a variant that is not shown, it is possible to treat a plurality of distinct parts using a plurality of devices of the invention optionally connected to the same generator. The parts may optionally be treated simultaneously.

The storage vessel 21 is dedicated to storing and renewing the electrolyte and no anodizing treatment is performed therein. By separating the storage vessel 21 from the treatment chamber 10, it is possible to configure devices of the invention so as to perform treatments additional to anodizing, as described in detail below. So far as the inventors are aware, these treatments additional to anodizing are not performed or are not performed in satisfactory manner in methods known in the state of the art.

Figure 2:
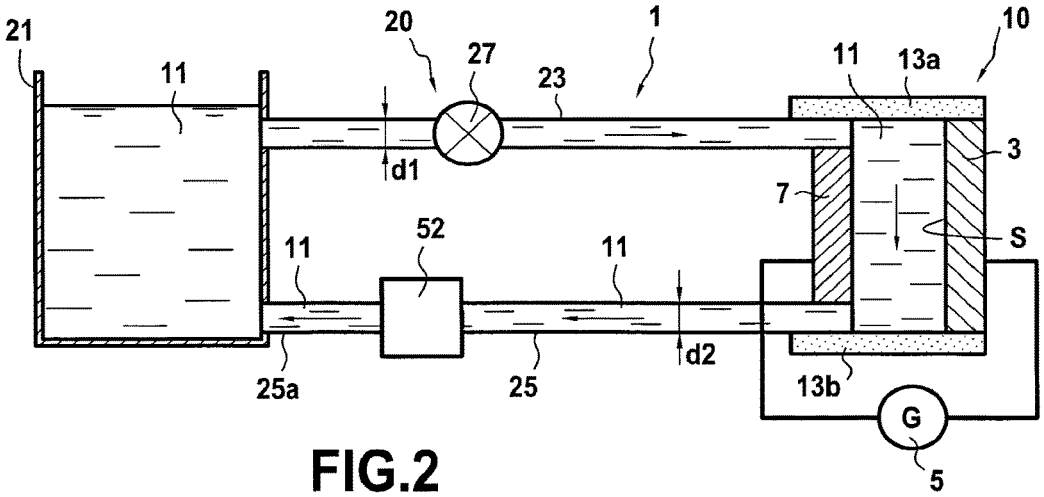
FIGS. 2 and 3 show other embodiments of devices of the invention.

FIG. 2 shows a variant of the device 1 of the invention. In this example, the device 1 also has a filter device 52 situated between the treatment chamber 10 and the storage vessel 21. The electrolyte present in the second channel 25 flows through the filter device 52 and is returned to the storage vessel 21 after being filtered via the channel 25*a*. By way of example, using such a filter device 52 advantageously makes it possible to eliminate particles that have not become attached to the anodic layer being formed, thereby purifying the electrolyte 11 before returning it to the treatment chamber 10.

Figure 3:
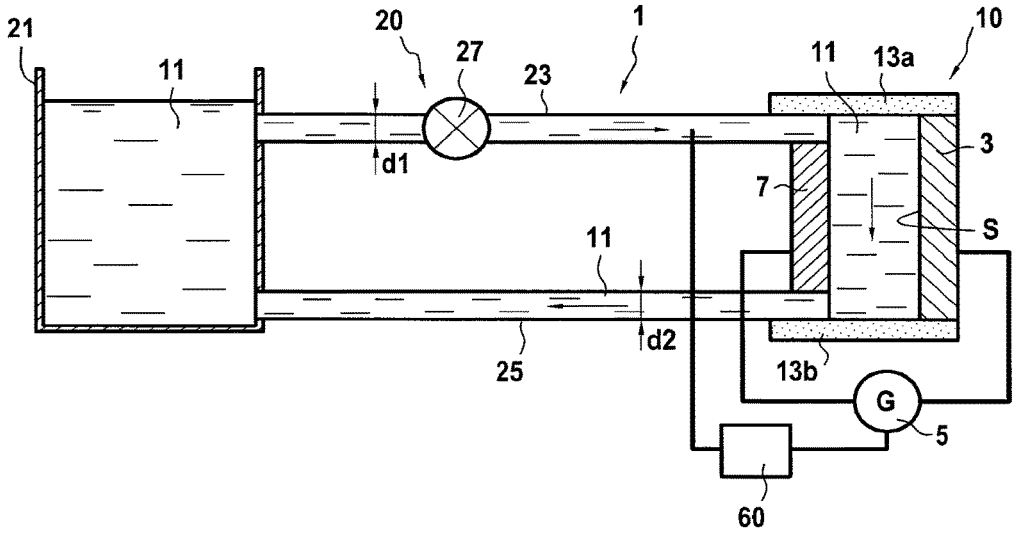

FIG. 3 shows a variant of the device 1 of the invention. The device 1 includes a sensor 60 for determining information about the electrolyte 11 flowing in the first channel 23. As a function of the information it determines, this sensor 60 makes it possible to act on the generator 5 in such a manner as to modify at least one characteristic of the anodizing treatment being performed. In a variant, the sensor may determine information about the electrolyte flowing in the second channel, or indeed it may determine both information about the electrolyte flowing in the first channel and information about the electrolyte flowing in the second channel, so as to modify the anodizing treatment that is being performed as a function of this information. By taking measurements upstream and/or downstream of the treatment chamber 10, this embodiment of the device 1 of the invention advantageously makes it possible to obtain information that is more reliable than the information that can be observed in the reaction chamber, thus making it possible to control the anodizing performed in the treatment chamber in satisfactory manner as a function of the information that has been determined. Typically, the information about the electrolyte that is determined by the sensor may concern one or more of the following parameters: the concentration of metallic species, e.g. aluminum, within the electrolyte, the pH, and the conductivity of the electrolyte. The electrolyte can become laden with metallic species progressively as the anodizing progresses, and this parameter, like the pH or the conductivity of the electrolyte, makes it possible to have an influence on the anodizing treatment that is performed. Direct control over the anodizing being performed may be advantageous in particular for performing anodizing treatments on parts that are to be used in the field of aviation and/or when performing anodizing treatments that are relatively lengthy.

The term "including/containing/comprising a" should be understood as "including/containing/comprising at least one".

The term "in the range . . . to . . . " should be understood as including the limits.

The invention claimed is:

1. A device for performing anodizing treatment on a part, the device comprising:

a treatment chamber comprising a part to be treated and a counter-electrode situated facing the part to be treated, the part to be treated constituting a first wall of the treatment chamber and the counter-electrode constituting a wall of the treatment chamber situated facing the first wall;

a generator, a first terminal of the generator being electrically connected to the part to be treated and a second terminal of the generator being electrically connected to the counter-electrode; and a system for storing and circulating an electrolyte, the system comprising:

a storage vessel, different from the treatment chamber, for containing the electrolyte, the treatment chamber having a volume that is less than the volume of the storage vessel; and a circuit for circulating the electrolyte in order to enable the electrolyte to flow between the storage vessel and the treatment chamber, wherein the counter-electrode is arranged not to be immersed in the electrolyte.

2. The device according to claim 1, further comprising at least one sealing gasket constituting a second wall of the treatment chamber, the second wall being different from the first wall.

3. The device according to claim 1, wherein the system for storing and circulating the electrolyte further includes a pump for driving circulation of the electrolyte through said system.

4. The device according to claim 1, wherein the ratio (volume of the treatment chamber)/(volume of the storage vessel) is less than or equal to 0.2.

5. The device according to claim 1, wherein the circuit for circulating the electrolyte comprises:

a first channel for enabling the electrolyte coming from the storage vessel to flow to the treatment chamber; and a second channel for enabling the electrolyte to flow from the treatment chamber to the storage vessel.

6. A method of anodizing a part, the method comprising the following steps:

forming a coating on a surface of the part by anodizing treatment using a device according to claim 1, an electrolyte being present in the treatment chamber during the anodizing treatment, and the electrolyte flowing in the electrolyte circulation circuit during the anodizing treatment.

7. The method according to claim 6, wherein the anodizing treatment is micro arc oxidation treatment.

8. The method according to claim 6, wherein during the anodizing treatment:

the electrolyte coming from the storage vessel flows to the treatment chamber through a first channel; and the electrolyte flows from the treatment chamber to the storage vessel through a second channel.

9. The method according to claim 6, wherein the electrolyte present in the treatment chamber is continuously renewed during the anodizing treatment.

10. The method according to claim 6, wherein the electrolyte flows in the electrolyte circulation circuit at a flow rate lying in the range 0.1 times to 10 times the volume of the treatment chamber, per minute.

11. The method according to claim 8, wherein it further includes a step of filtering the electrolyte flowing in the second channel prior to its return into the storage vessel.

12. The method according to claim 8, wherein it further includes the following steps:

determining at least information relating to the electrolyte flowing in the first channel and/or in the second channel; and modifying at least one characteristic of the anodizing treatment, this modification being performed as a function of the information determined about the electrolyte.

* * * * *